United States Patent [19]

Costa

[11] Patent Number: 4,647,232

[45] Date of Patent: Mar. 3, 1987

[54] MULTICOLOR THERMAL PRINTER

[75] Inventor: Jorge Costa, Yverdon, Switzerland

[73] Assignee: Hermes Precisa International S.A., Yverdon, Switzerland

[21] Appl. No.: 756,222

[22] Filed: Jul. 18, 1985

[30] Foreign Application Priority Data

Aug. 3, 1984 [CH] Switzerland ..... 3751/84

[51] Int. Cl.[4] ..... B41J 35/23; B41J 33/52; B41J 3/20

[52] U.S. Cl. ..... 400/120; 400/206.3; 400/208; 400/216.1; 400/240.4; 400/231; 400/214; 346/76 PH; 219/216

[58] Field of Search ..... 400/120, 200, 206.3, 400/214, 231, 240, 240.4, 205.1, 206, 206.2, 207, 208, 208.1, 216.1; 101/96, 100; 219/216; 346/76 PH

[56] References Cited

U.S. PATENT DOCUMENTS

| | | | |
|---|---|---|---|
| 891,047 | 6/1908 | Doane | 400/214 |
| 933,186 | 9/1909 | Latta | 400/214 |
| 1,030,500 | 6/1912 | Brown | 400/214 |
| 3,926,109 | 12/1975 | Filsinger et al. | 400/206.3 X |
| 4,378,566 | 3/1983 | Tsukamura | 400/120 X |
| 4,498,792 | 2/1985 | Falconeri | 400/214 |
| 4,564,303 | 1/1986 | Rosenberg et al. | 400/206.3 X |

FOREIGN PATENT DOCUMENTS

| | | | |
|---|---|---|---|
| 59923 | 9/1982 | European Pat. Off. | 400/216.1 |
| 69189 | 6/1981 | Japan | 400/206.3 |
| 131586 | 8/1982 | Japan | 400/214 |
| 183279 | 10/1983 | Japan | 400/214 |
| 215386 | 12/1983 | Japan | 400/214 |
| 104984 | 6/1984 | Japan | 400/214 |
| 2119318 | 11/1983 | United Kingdom | 400/120 |

OTHER PUBLICATIONS

IBM Tech. Disc. Bulletin, "Multiple Ribbon Cartridge Color Printer", Meier et al., vol. 22, No. 10, Mar. 1980, pp. 4481–4482.

IBM Tech. Disc. Bulletin, "Multicolor Matrix Impact Printer", Meier, vol. 21, No. 11, Apr. 1979, pp. 4448–4451.

IBM Tech. Disc. Bulletin, "Daisy Wheel Printer with Individually Fed Color Ribbons", Ku et al., vol. 26, No. 4, Sep. 1983, pp. 1772–1773.

*Primary Examiner*—Edgar S. Burr

*Assistant Examiner*—James R. McDaniel

[57] ABSTRACT

The multicolor thermal printer comprises a frame (1), a platen (4) and a carriage (2) that can move along the platen (4). This carriage (2) consists of a lower part (5) carrying the thermal print head (3) and an upper part (6) hinged to the part (5) thanks to a hinge pin (7*a*). The upper part (6) carries four inking ribbons (31) located on levels of height increasing from the front to the rear so that the inking ribbons are arranged in a vertically offset fashion on the ribbon guides (40). By pivoting of the upper part (5), the ribbons can be placed successively opposite the heating elements (3*a*). A drive mechanism (53 to 68) for the ribbons is made so as to drive only the ribbon placed opposite the heating elements (3*a*) and only when the carriage (2) is moved in the direction of printing.

By this design, a fast change of the printing color and a reduced consumption of inking ribbons can be attained.

7 Claims, 8 Drawing Figures

MULTICOLOR THERMAL PRINTER

This invention relates to a multicolor thermal printer comprising a frame and a carriage that can move along a printing support, the carriage carrying a thermal print head having heating elements and an inking ribbon unwound from a delivery spool and wound on a take-up spool.

Thermal printers of this type are known comprising an inking ribbon having zones of various colors, for example black, yellow, cyan and magenta, arranged longitudinally in a predetermined sequence. When it is desired to change color, it is necessary to advance the inking ribbon to the next zone of the desired color. There results a rather long waiting time and a considerable loss of unused ribbon.

Other multicolor thermal printers are equipped with an inking ribbon comprising three or four bands of vertically superposed colors. Guide forks in this case make it possible to raise or lower the ribbon to place the band of the desired color opposite the heating elements. Printers of this type also exhibit the drawback of an excessive consumption of inking ribbon.

The purpose of this invention is to create a multicolor thermal printer that makes it possible to limit to a minimum the consumption of inking ribbon while assuring a fast change of the color to be printed. For this purpose, the printer according to the invention is characterized in that the carriage consists of two parts, a first part carrying the thermal print head, the second part supporting several independent inking ribbons located opposite the thermal head at different levels of height, the carriage comprising a color selection mechanism that makes it possible to move the second part in relation to the first part so as to place one or the other of the inking ribbons opposite the heating elements.

The accompanying drawing represents diagrammatically and by way of example, an embodiment of the printer that is the object of the invention.

Figure 4:
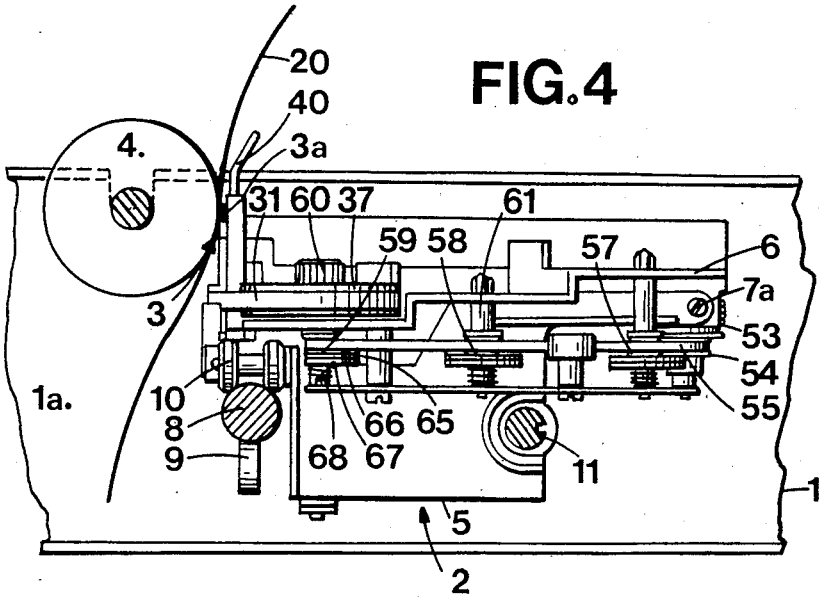
FIG. 4 represents the carriage in side view along straight line IV—IV of FIG. 1.

The thermal printer comprises a frame 1 having side walls 1*a* and 1*b*, a platen 4 (FIG. 4) and a carriage 2 carrying a head 3 for printing by thermal transfer. Carriage 2 is made up of a lower part 5 and an upper part 6 hinged to lower part 5 along a hinge pin 7 consisting of two bolts 7*a* and 7*b*.

Lower part 5 is mounted to slide on a stationary cross bar 8 by small wheels 9, 10 and on a universal bar 11 housed in bearings 12 of side walls 1*a*, 1*b* of the frame. Carriage 2 is driven by a motor 13 that works with a drive belt 14 fastened by two rivets 16 to the base of carriage 2. This belt 14 is stretched by a belt tensioning roller 15 mounted on side walls 1*b*.

Thermal printing head 3 comprises a vertical row of heating elements 3*a* (FIG. 4) each connected to a control unit, not shown, that, thanks to a printing signal, makes it possible to have an electric current flow in the heating elements to cause the thermal transfer of ink from an inking ribbon to the paper 20 to be printed at the place considered, under the influence of temperature and pressure.

Figure 2:
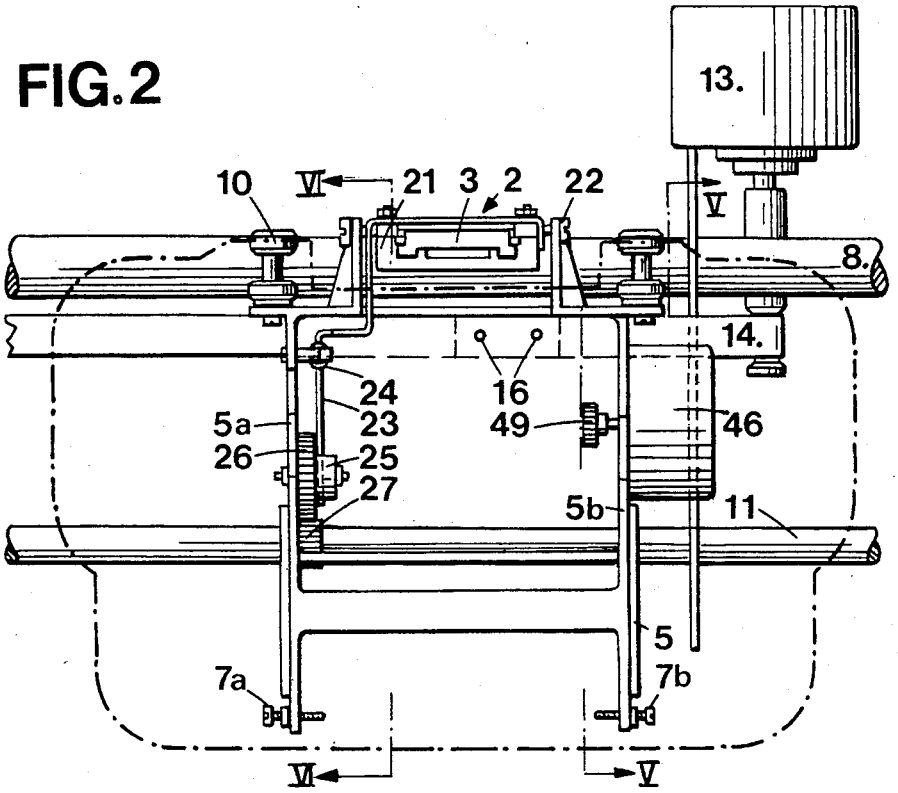
FIG. 2 is a top view of the lower part of the carriage.
Figure 3:
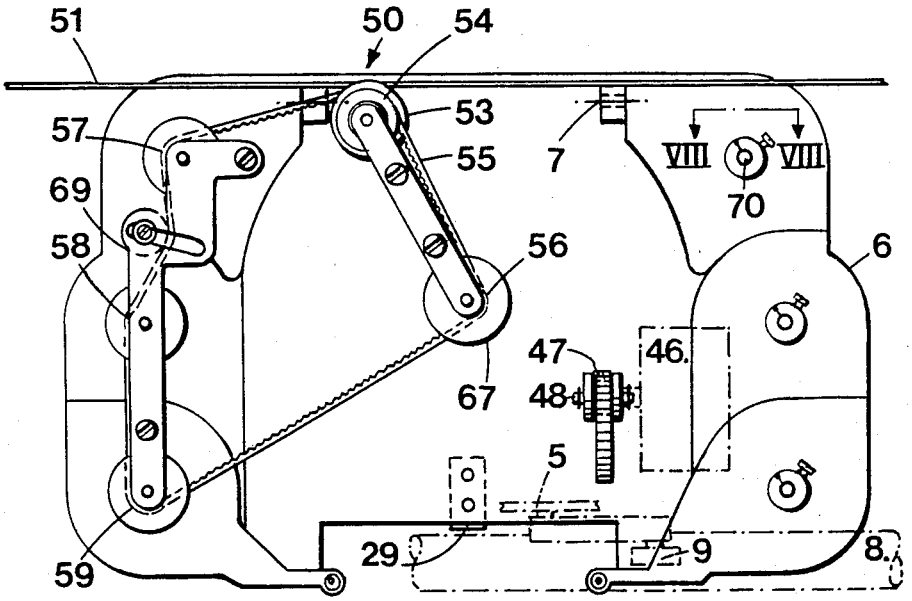
FIG. 3 is a bottom view of the upper part of the carriage.
Figure 6:
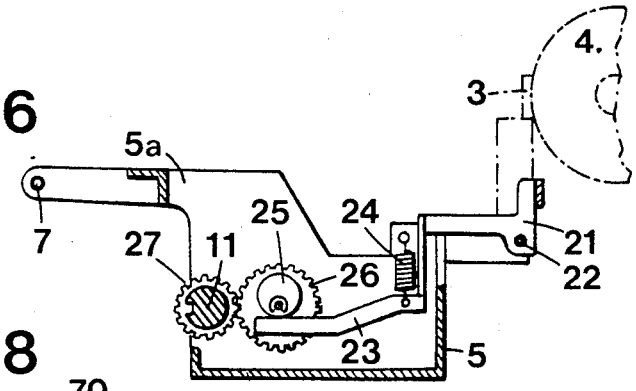
FIG. 6 is a section along VI—VI of FIG. 2.

Thermal head 3 is carried by a support part 21 mounted to pivot on lower part 5 of carriage 2 thanks to two bolts 22 (FIGS. 2 and 6). An operating lever 23 is fixed relative the support part 21, and subject to the action of a spring 24. This lever 23 pulls print head 3 in the direction of platen 4. A cam 25 mounted to pivot on one of side walls 5*a* of the carriage is fixed to a toothed wheel 26 and makes it possible to separate head 3 from platen 4 against the action of spring 24. The rotation of cam 25 is controlled by universal bar 11 on which is mounted to slide a toothed wheel 27 angularly fixed relative bar 11 and meshing with toothed wheel 26. A motor, not shown, fastened to the frame makes it possible to drive universal bar 11 and thus to control the placing of thermal head 3 against platen 4, when printing must be performed, or to separate it in the opposite case (FIG. 6).

Figure 1:
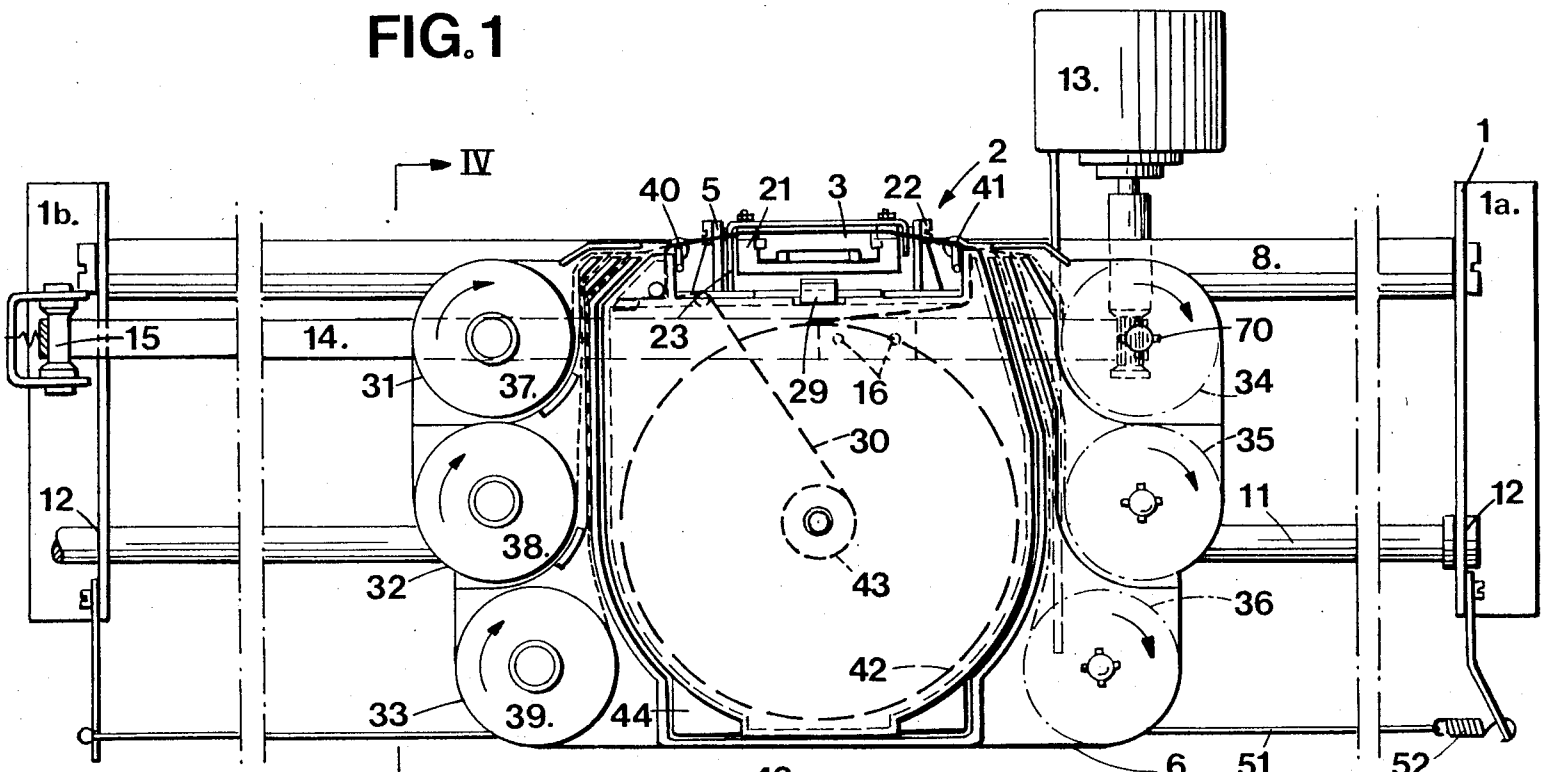
FIG. 1 is a top view of the printer.
Figure 7:
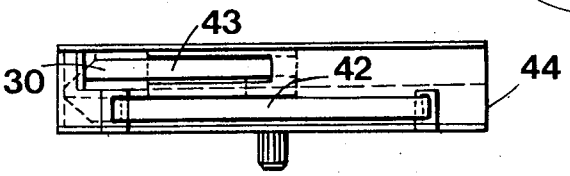
FIG. 7 is a front view of the cassette for the black ribbon.

Upper part 6 of the carriage consists of a support plate carrying four inking ribbons 30 to 33 (FIG. 1). Black inking ribbon 30 is contained in a cassette 44 in which the ribbon is unwound from a superposed upper delivery spool 42 to a lower take-up spool 43 (FIG. 7). This cassette 44 is held on part 6 thanks to a blade spring 29.

Figure 5:
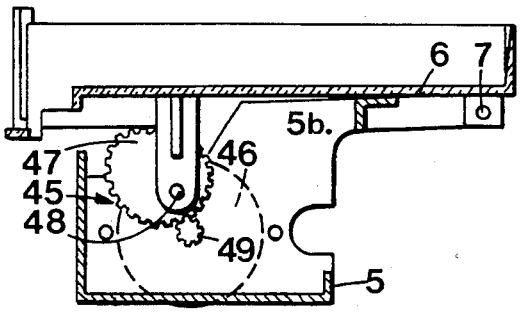
FIG. 5 is a section along V—V of FIG. 2.

The three ribbons 31 to 33 corresponding to the colors yellow, cyan and magenta are unwound from delivery spools 34 to 36 and wound on take-up spools 37 to 39. These spools are located on three levels of a height increasing from the front to the rear of carriage upper part or plate 6 (FIG. 4) so that ribbons 30 to 33 are at four different heights on ribbon guides 40 and 41, the black ribbon being located highest. By pivoting plate 6 around shaft 7, the height of the front of the carriage upper plate 6 is varied such that a selected one of ribbons 30 to 33 can be placed opposite the heating elements. For this purpose, the machine comprises a color selection mechanism 45 (FIG. 5) comprising a motor 46 fastened to side wall 5*b* of the carriage lower part that drives a toothed wheel 49 which, in turn, meshes with a toothed cam 47 mounted on a shaft 48 solid with upper plate 6. Motor 46 is controlled by a central control unit, not shown, and thus makes it possible to determine the choice of colors to be printed by rotation of cam 47, whereby the upper part 6 is selectively pivoted about the axis 7.

Drive mechanism 50 for inking ribbons 30 to 33 comprises a cord 51 stretched between the two side walls 1*a*, 1*b* of frame 1 thanks to a spring 52. This cord 51 is wound around a roller 53 mounted on plate 6. Roller 53 works with a free wheel device, not shown, with a coaxial toothed wheel 54 to operate a synchronous drive belt 55 when carriage 2 moves from left to right in the direction of writing. Roller 53 freewheels when the carriage moves from right to left.

Synchronous belt 55, in turn, works with four toothed drive wheels 56–59 intended to drive take-up spools 37 to 39 and 43. Hubs 60 of these spools fit on drive shafts 61 (FIG. 4) each connected to one of toothed wheels 56–59 by a friction clutch 65. The latter consists of two disks 66, 67 one solid with one of toothed wheels 56–59 and the other with one of drive shafts 61. A spring 68 urges the two disks 66, 67 against one another. The tension of synchronous belt 55 is adjusted thanks to a belt tensioning roller 69.

Figure 8:
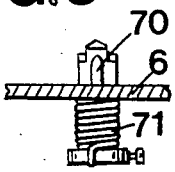
FIG. 8 represents a feature in section along VIII—VIII of FIG. 3.

The hubs of the delivery spools are mounted on shafts 70 (FIG. 8) each of which comprises an helical spring 71 one end of which is solid with shaft 70 and the other end of which rests against plate 6. This spring 71 provides a certain braking and return force so that inking ribbons 30 to 33 are constantly stretched. The braking force of springs 71 is greater than the friction force imparted by disk clutches 65. Thus, when print head 3 is disengaged from platen 4, none of ribbons 30 to 33 is moved. On the other hand, when print head 3 presses one of ribbons 30 to 33 against paper 20 and platen 4, the ribbon in question is advanced while carriage 2 moves. The sum of the friction force of clutch 65 and of the force holding the ribbon between head 3 and platen 4 is therefore greater than the braking force applied by helical spring 71. Thanks to this construction, only the ribbon actually used for printing is unwound.

I claim:

1. Multicolor thermal printer comprising a frame and a carriage that can move along a printing support, the carriage carrying a thermal print head having heating elements and an inking ribbon unwound from a delivery spool and wound on a take-up spool, characterized in that the carriage comprises two parts, a first part carrying the thermal print head, the second part supporting several independent ones of said inking ribbons for disposition opposite the thermal head at levels of different height, said second part of the carriage including a support plate hinged to the first part by a pivot shaft located on a side of the carriage opposite that of the print head, said second part support plate supporting in its middle part a cassette containing a black inking ribbon wound on a delivery spool superposed over a black inking ribbon take-up spool, said second part support plate supporting three additional delivery spools and three additional take-up spools for inking ribbons each of a different color, said three additional delivery spools and take-up spools respectively disposed laterally on two sides of said cassette and at levels of different height, said second part support plate having in its front part opposite said side away from the print head, two guides respectively disposed on the two sides of the print head, all said inking ribbons disposed upon said two guides in a vertically stacked manner, said carriage including a shiftable mechanism for selecting the colors to be printed, and actuation of said shiftable mechanism causing pivotal movement of said second part in relation to said first part so as to place one or the other of said inking ribbons opposite said heating elements.

2. Printer as in claim 1 including a drive mechanism for the inking ribbons comprising a drive belt engageable with drive wheels adapted to drive in rotation shafts on which said take-up spools are mounted, said belt being driven by a roller on which a stretched cord is wound whose two ends are fastened to the side walls of the frame.

3. Printer as in claim 2 including a small drive wheel engaged by said belt, said small drive wheel being connected to said roller in a free wheel manner, whereby said belt is driven when the carriage moves in the direction of writing and wherein said belt is not driven when the carriage moves in the opposite direction.

4. Printer as in claim 3 wherein said print head is fastened on a support pivotally mounted on said first part of the carriage and wherein the printer includes a control mechanism operable to shift said print head support against the printing support during printing and to disengage the print head therefrom after printing.

5. Printer as in claim 4 wherein said delivery spools are mounted on shafts equipped with a braking and elastic return device and wherein said shafts of said take-up spools are each connected to said drive wheels by a friction clutch device, the braking force of the braking device being greater than the friction force of the clutch device so that an inking ribbon is driven only when it is clamped between the print head and the printing support and when the carriage moves in the writing direction.

6. Printer as in claim 1 wherein said shiftable mechanism comprises a cam mounted to pivot around a shaft carried by said second part, and said cam engaged by a drive wheel whose rotating shaft is mounted on said first part of the carriage.

7. Multicolor thermal printer comprising a frame and a carriage that can move along a printing support, the carriage carrying a thermal print head having heating elements and an inking ribbon unwound from a delivery spool and wound on a take-up spool, characterized in that the carriage comprises two parts, a first part carrying the thermal print head, the second part supporting several independent ones of said inking ribbons for disposition opposite the thermal head at levels of different height, said second part of the carriage including a support plate hinged to the first part by a pivot shaft located on a side of the carriage opposite that of the print head, said second part support plate supporting in its middle part a cassette containing a black inking ribbon wound on a delivery spool superposed over a black inking ribbon take-up spool, said second part support plate supporting three additional delivery spools and three additional take-up spools for inking ribbons each of different color, said three additional delivery spools and take-up spools respectively disposed laterally on two sides of said cassette and at levels of different height, said second part support plate having in its front part opposite said side away from the print head, two guides respectively disposed on the two sides of the print head, all said inking ribbons disposed upon said two guides in a vertically stacked manner, said delivery spools mounted on shafts having a braking device with elastic return, additional shafts joined to each said take-up spool and each connected to a drive wheel of a belt-driven mechanism by a friction clutch device, said carriage including a shiftable mechanism for selecting the colors to be printed actuation of said shiftable mechanism causing pivotal movement of said second part in relation to said first part so as to place one or the other of said inking ribbons opposite said heating elements, and the braking force of said braking device is greater than the friction force of said clutch device so that an inking ribbon is driven only when it is disposed between the printing head and the printing support, when the carriage moves in a writing direction.

* * * * *